US007654630B2

(12) United States Patent
Marra, III et al.

(10) Patent No.: US 7,654,630 B2
(45) Date of Patent: Feb. 2, 2010

(54) METHOD FOR DECREASING SENSITIVITY TO ERRORS IN AN IMAGING APPARATUS

(75) Inventors: Michael Anthony Marra, III, Lexington, KY (US); Randall David Mayo, Georgetown, KY (US); John Thomas Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 460 days.

(21) Appl. No.: 11/684,092

(22) Filed: Mar. 9, 2007

(65) Prior Publication Data

US 2008/0218543 A1 Sep. 11, 2008

(51) Int. Cl.
*B41J 29/393* (2006.01)

(52) U.S. Cl. ..... 347/19; 347/41

(58) Field of Classification Search ..... 347/15, 347/19, 41, 43

See application file for complete search history.

(56) References Cited

U.S. PATENT DOCUMENTS

| | | | | |
|---|---|---|---|---|
| 6,428,139 | B1 * | 8/2002 | Silverbrook | 347/19 |
| 6,491,373 | B1 * | 12/2002 | Fujita et al. | 347/41 |
| 6,726,303 | B2 * | 4/2004 | Otsuki | 347/19 |

* cited by examiner

*Primary Examiner*—Lamson D Nguyen

(57) ABSTRACT

A method for decreasing sensitivity to errors in an imaging apparatus includes, defining an ideal pattern of dot locations as a rectilinear grid formed by an intersection of a plurality of rasters and a plurality of vertical columns; for each raster of the plurality of rasters defining a plurality of groups of dot locations; and for each raster of the plurality of rasters, vertically shifting some groups of the plurality of groups of dot locations while not vertically shifting a remainder of groups of the plurality of groups of dot locations so as to define a non-ideal vertically shifted pattern of dot locations.

7 Claims, 10 Drawing Sheets

METHOD FOR DECREASING SENSITIVITY TO ERRORS IN AN IMAGING APPARATUS

FIELD OF THE INVENTION

The present invention relates to printing, and, more particularly, to a method for decreasing sensitivity to errors in an imaging apparatus.

BACKGROUND OF THE INVENTION

Ink jet printing systems produce images by printing patterns of dots on a print medium, such as a sheet of paper. The dots are formed by drops of ink contacting the print medium. Such systems typically include two main mechanisms for determining the location of dots on the print medium, namely, a halftone mechanism and a shingling mechanism. Such mechanisms may be implemented, for example, in software, firmware, hardware, or a combination thereof, and may reference one or more lookup tables.

Typically, between passes of a printhead over a print medium, e.g., a sheet of paper, during a printing operation, the print medium is advanced, i.e., indexed, in the sheet feed direction by some amount. However, indexing errors can occur during the feeding of the print medium. For example, although the desired sheet feed amount may be some fraction (1/N) of the height of the printhead between successive passes, typically the paper advances either a little more (overfeed) or a little less (underfeed) than requested.

The ratio of dot size versus print resolution also is an important property of a printing system with respect to robustness to typical errors, such as indexing errors. If the dot size and spacing of the drops are such that the there is little overlap between adjacent drops, the printing system will be sensitive to small placement errors.

SUMMARY OF THE INVENTION

The present invention relates to a method for decreasing sensitivity to errors in an imaging apparatus by introducing controlled non-ideal displacement of dots formed by the ink drops in order to increase the robustness of the imaging apparatus to errors, such as for example, small errors attributable to indexing the print media and/or errors caused by printhead carrier vibrations.

As used herein, the terms "first" and "second" preceding an element name, e.g., first group, second group, first raster, second raster, etc., are for identification purposes to distinguish between similar elements, and are not intended to necessarily imply order, nor are the terms "first" and "second" intended to preclude the inclusion of additional similar elements.

Also, as used herein, the terms "horizontal" and "vertical" corresponds to directions within or parallel to the plane of a print medium, such as a sheet of paper, unless otherwise specified.

The invention, in one form thereof, is directed to a method for decreasing sensitivity to errors in an imaging apparatus. The method includes, defining an ideal pattern of dot locations as a rectilinear grid formed by an intersection of a plurality of rasters and a plurality of vertical columns; for each raster of the plurality of rasters defining a plurality of groups of dot locations; and for each raster of the plurality of rasters, vertically shifting some groups of the plurality of groups of dot locations while not vertically shifting a remainder of groups of the plurality of groups of dot locations so as to define a non-ideal vertically shifted pattern of dot locations.

The invention, in another form thereof, is directed to a method for generating a non-ideal vertically shifted pattern of dot locations in multi-pass printing. The method includes (a) selecting a shingling pattern for each pass of a plurality of passes to be made by a printhead over a print medium, each pass being assigned a pass number; (b) selecting a current index move for loading the print medium to a first print position; (c) determining an amount of index offset to be used based on the pass number of the current pass; (d) indexing the print medium by the current index move as modified by the index offset; and (e) printing dots on the print medium as specified by the shingle pattern.

The invention, in another form thereof, is directed to an apparatus for printing dots in an area on a print medium using a plurality of printing passes of a printhead over the area. The apparatus includes a printhead carrier for carrying the printhead over the print medium. A media transport system is configured for advancing the print medium by indexed moves. A controller is communicatively coupled to the printhead and the media transport system. The controller executes program instructions to perform (a) selecting a shingling pattern for each pass of a plurality of passes to be made by the printhead over the print medium, each pass being assigned a pass number; (b) selecting a current index move for loading the print medium to a first print position; (c) determining an amount of index offset to be used based on the pass number of the current pass; (d) indexing the print medium by the current index move as modified by the index offset; and (e) printing dots on the print medium as specified by the shingle pattern.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DESCRIPTION OF THE PREFERRED EMBODIMENT

Figure 1:
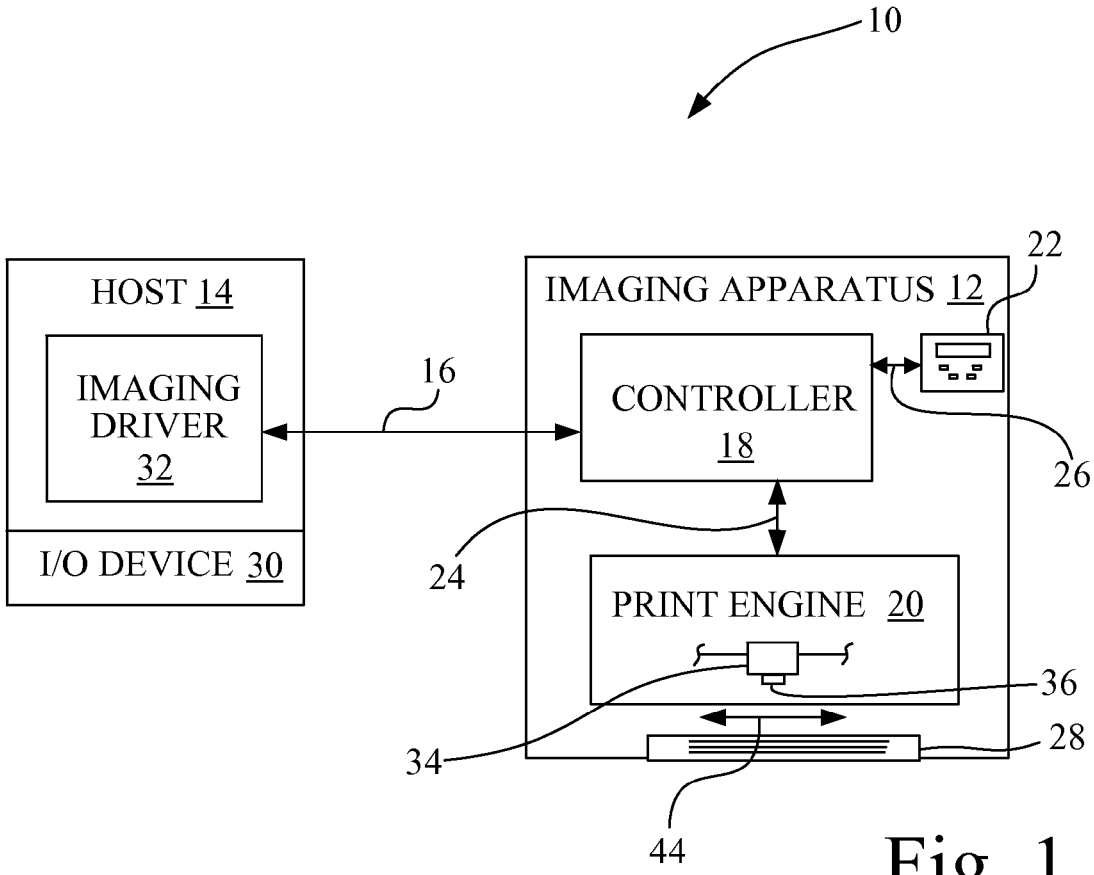
FIG. 1 is a diagrammatic representation of an imaging system employing an embodiment of the present invention.

FIG. 1 is a diagrammatic depiction of an imaging system 10 embodying the present invention. Imaging system 10 may include an imaging apparatus 12 and a host 14, with imaging apparatus 12 communicating with host 14 via a communications link 16. Alternatively, imaging apparatus 12 may be a standalone unit that is not communicatively linked to a host, such as host 14. For example, imaging apparatus 12 may take the form of a multifunction machine that includes standalone copying and facsimile capabilities, in addition to optionally serving as a printer when attached to a host, such as host 14.

Imaging apparatus 12 may be, for example, an ink jet printer and/or copier. Imaging apparatus 12 includes a controller 18, a print engine 20 and a user interface 22. In the context of the examples for imaging apparatus 12 given above, print engine 20 may be, for example, an ink jet print engine configured for forming an image on a print medium 28, e.g., a sheet of paper, transparency or fabric.

Controller 18 includes a processor unit and associated memory, and may be formed as an Application Specific Integrated Circuit (ASIC). Controller 18 communicates with print engine 20 via a communications link 24. Controller 18 communicates with user interface 22 via a communications link 26.

Host 14 may be, for example, a personal computer including an input/output (I/O) device 30, such as keyboard and display monitor. Host 14 further includes a processor, input/output (I/O) interfaces, memory, such as RAM, ROM, NVRAM, and a mass data storage device, such as a hard drive, CD-ROM and/or DVD units. During operation, host 14 includes in its memory a software program including program instructions that function as an imaging driver 32, e.g., printer driver software, for imaging apparatus 12. Imaging driver 32 is in communication with controller 18 of imaging apparatus 12 via communications link 16. Imaging driver 32 facilitates communication between imaging apparatus 12 and host 14, and may provide formatted print data to imaging apparatus 12, and more particularly, to print engine 20.

Alternatively, however, all or a portion of imaging driver 32 may be located in controller 18 of imaging apparatus 12. For example, where imaging apparatus 12 is a multifunction machine having standalone capabilities, controller 18 of imaging apparatus 12 may include an imaging driver configured to support a copying function, and/or a fax-print function, and may be further configured to support a printer function. In this embodiment, the imaging driver facilitates communication of formatted print data to print engine 20.

Communications link 16 may be established by a direct cable connection, wireless connection or by a network connection such as for example an Ethernet local area network (LAN). Communications links 24 and 26 may be established, for example, by using standard electrical cabling or bus structures, or by wireless connection.

Print engine 20 may include, for example, a reciprocating printhead carrier 34 that carries at least one ink jet printhead 36, and may be mechanically and electrically configured to mount, carry and facilitate multiple cartridges, such as a monochrome printhead cartridge and/or one or more color printhead cartridges, each of which includes a respective ink jet printhead 36. For example, in systems using cyan, magenta, yellow and black inks, printhead carrier 34 may carry four printheads, one printhead for each of cyan, magenta, yellow and black. As a further example, a single printhead, such as ink jet printhead 36, may include multiple ink jetting arrays, with each array associated with one color of a plurality of colors of ink. In such a printhead, for example, ink jet printhead 36 may include cyan, magenta, and yellow nozzle arrays for respectively ejecting full strength cyan (C) ink, full strength magenta (M) ink and yellow (Y) ink. Further, ink jet printhead 36 may include dilute colors, such as dilute cyan (c), dilute magenta (m), etc. The term, dilute, is used for convenience to refer to an ink that is lighter than a corresponding full strength ink of substantially the same chroma, and thus, such dilute inks may be, for example, either dye based or pigment based.

Figure 2:
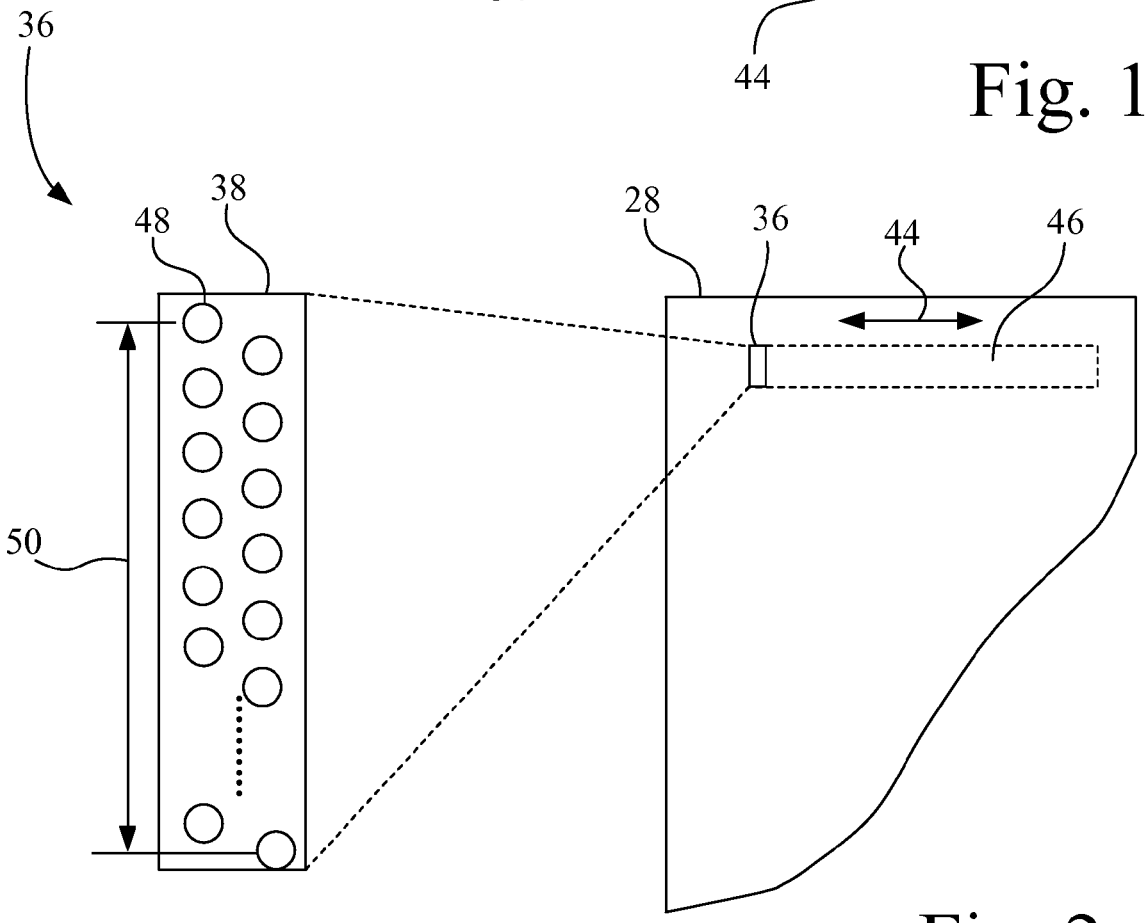
FIG. 2 is a diagrammatic representation of a printhead defining a swath on a print medium.

FIG. 2 illustrates an exemplary nozzle configuration of ink jet printhead 36, including a monochrome nozzle array 38 for ease of discussion. Printhead carrier 34 is controlled by controller 18 to move ink jet printhead 36 in a reciprocating manner along a bi-directional scan path 44, which will also be referred to herein as horizontal direction 44. Each left to right, or right to left movement of printhead carrier 34 along bi-directional scan path 44 over print medium 28 will be referred to herein as a pass. The region traced by ink jet printhead 36 over print medium 28 for a given pass is referred to herein as a swath, such as for example, swath 46 as shown in FIG. 2.

In the exemplary nozzle configuration for ink jet ink jet printhead 36 shown in FIG. 2, nozzle array 38 includes a plurality of ink jetting nozzles 48. As within a particular nozzle array, the nozzle size may be, but need not be, the same size. A swath height 50 of swath 46 corresponds to the distance between the uppermost and lowermost of the nozzles of ink jet printhead 36.

Those skilled in the art will recognize that the discussion above with respect to FIG. 2 regarding a monochrome nozzle array 38 may be easily applied to a color printing, e.g., where ink jet printhead 36 is a color printhead including multiple arrays representing a plurality of primary full strength colors and/or dilute colors of ink.

Figure 3:
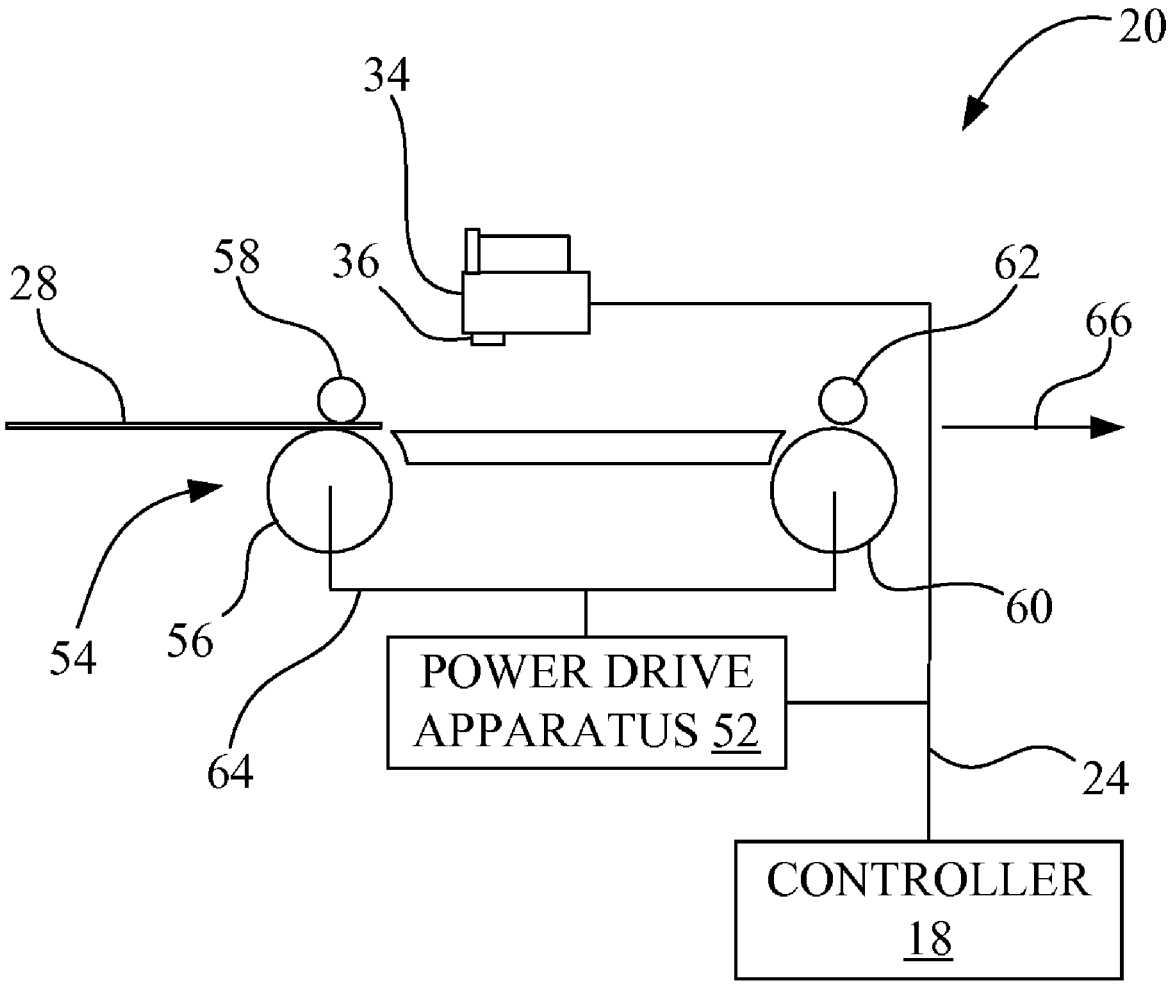
FIG. 3 is a diagrammatic representation of the print engine in the imaging system of FIG. 1, depicting a power drive apparatus and a media transport system used to transport the print medium.

Referring also to FIG. 3, print engine 20 also includes a power drive apparatus 52 and media transport system 54 used to transport a media sheet, such as print medium 28. Media transport system 54 includes a feed roller set 56 and corresponding pinch roller set 58, and an exit roller set 60 and corresponding backup roller set 62. Print engine 20 may further include a sheet picking device for picking print medium 28 from a media supply tray (not shown). Power drive apparatus 52 is drivably coupled via a transmission device 64, diagrammatically illustrated by interconnected lines, to each of feed roller set 56 and exit roller set 60.

Power drive apparatus 52 may include as a power source a motor, such as a direct current (DC) motor or a stepper motor.

Transmission device 64 may be, for example, a set of gears and/or belts, and clutches configured to transmit a rotational force to the respective roller sets 56 and/or 60 at the appropriate time, in conjunction with commands supplied to power drive apparatus 52 from controller 18, to transport print medium 28. Feed roller set 56 and exit roller set 60, for example, may be drivably coupled together, for example, via a pulley/belt system or a gear train. A position of the print medium 28 in relation to ink jet printhead 36 may be determined by controller 18, and print medium 28 is incrementally moved, i.e., indexed, relative to ink jet printhead 36 in a sheet feed direction 66 by media transport system 54.

Figure 4:
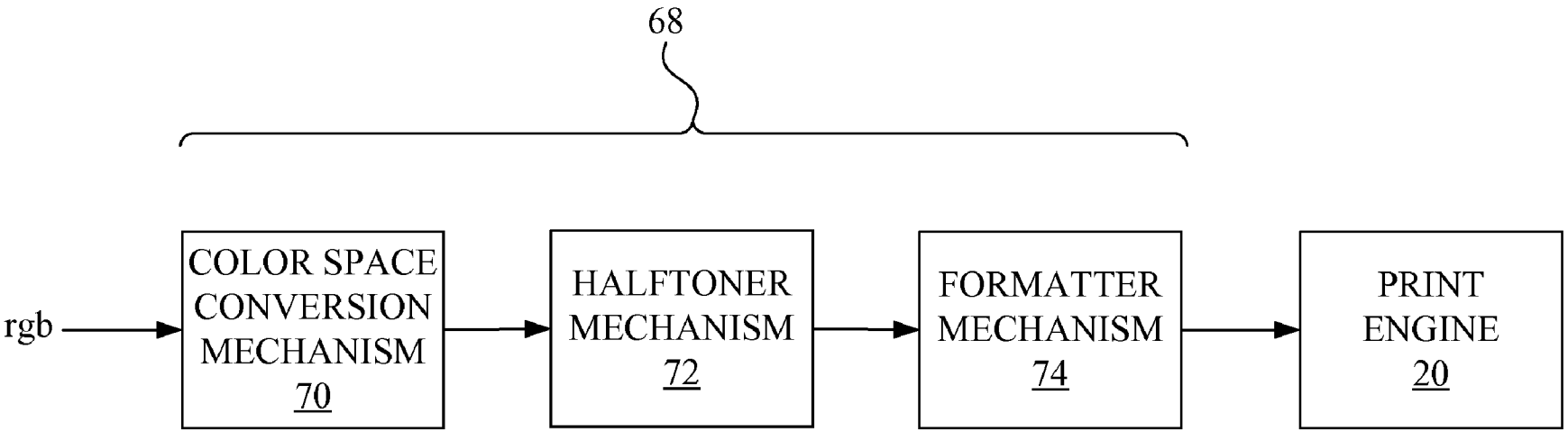
FIG. 4 is a block diagram of a data conversion mechanism of the imaging system of FIG. 1.

Referring to FIG. 4, in order for print data from host 14 to be properly printed by print engine 20, data to be printed is converted into data compatible with print engine 20 and ink jet printhead 36. In this example, an exemplary data conversion mechanism 68 is used to convert rgb data, generated for example by host 14, into data compatible with print engine 20 and ink jet printhead 36.

Data conversion mechanism 68 may be located in imaging driver 32 of host 14, in controller 18 of imaging apparatus 12, or a portion of data conversion mechanism 68 may be located in each of imaging driver 32 and controller 18. Data conversion mechanism 68 includes a color space conversion mechanism 70, a halftoner mechanism 72, and a formatter mechanism 74. Each of color space conversion mechanism 70, halftoner mechanism 72, and formatter mechanism 74 may be implemented in software, firmware, hardware, or a combination thereof, and may be in the form of program instructions and associated data arrays and/or lookup tables.

In general, color space conversion mechanism 70 takes signals from one color space domain and converts them into signals of another color space domain for each image generation. As is well known in the art, color conversion takes place to convert from a light-generating color space domain of, for example, a color display monitor that utilizes primary colors red (r), green (g) and blue (b) to a light-reflective color space domain of, for example, a color printer that utilizes colors, such as for example, cyan (C), magenta (M), yellow (Y) and black (K).

In the example of FIG. 4, rgb data, such as the output from an application executed on host 14, is supplied to color space conversion mechanism 70 to generate continuous tone data. The continuous tone data representing the image to be printed is then processed by halftoner mechanism 72 using a halftoning algorithm, such as an error diffusion halftoning algorithm, to generate a halftone pattern. Formatter mechanism 74 then processes the halftone pattern through a shingling algorithm to determine on which pass of a plurality of printing passes of the ink jet printhead 36 over a given print area that particular dots of ink are to be deposited on print medium 28. Formatter mechanism 74 outputs each shingled pattern of dots to print engine 20 for printing on separate printing passes over the given area on print medium 28, with each pixel location, i.e., a potential dot location, in the given area being traced by ink jet printhead 36 a number of times corresponding to the number of printing passes.

Figure 5A:
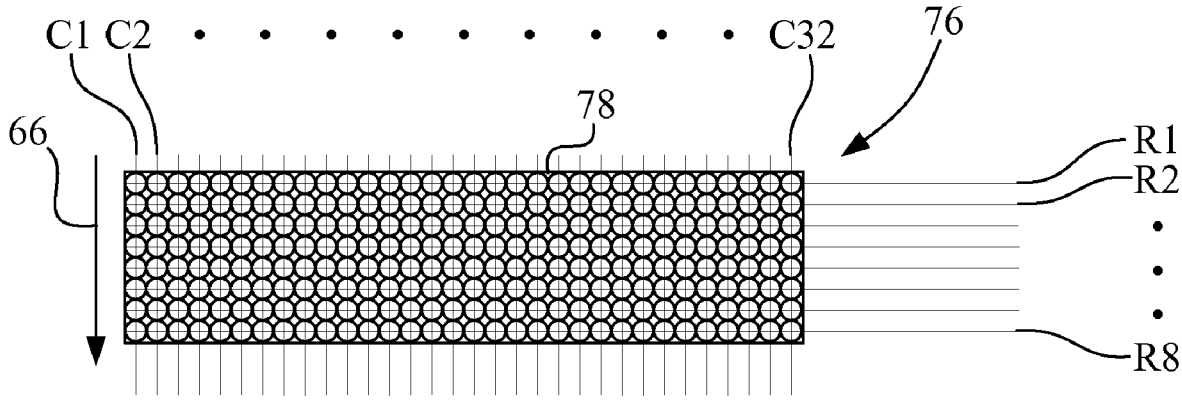
FIG. 5A illustrates an exemplary ideal pattern of dot locations.

FIG. 5A illustrates an exemplary ideal pattern of dot locations 76 formed in an exemplary print area 78 that is defined as a rectilinear grid formed of a plurality of horizontal raster lines R1, R2 . . . R8 and a plurality of vertical columns C1, C2 . . . C32. The exemplary ideal pattern of dot locations 76 is uniform, and in this example, individual dots are placed on a spacing equivalent to their respective dot size, i.e., dot size/dot spacing=1 (i.e., unity). For this example, assume that each dot has a diameter of 21 micrometers (um) diameter, and is placed at a spacing of 21 um. In reality, such an ideal pattern of dot locations 76 typically is not achievable during printing due to typical errors in an imaging apparatus, such as media indexing errors that are introduced by media transport system 54, as illustrated in FIG. 5B.

Figure 5B:
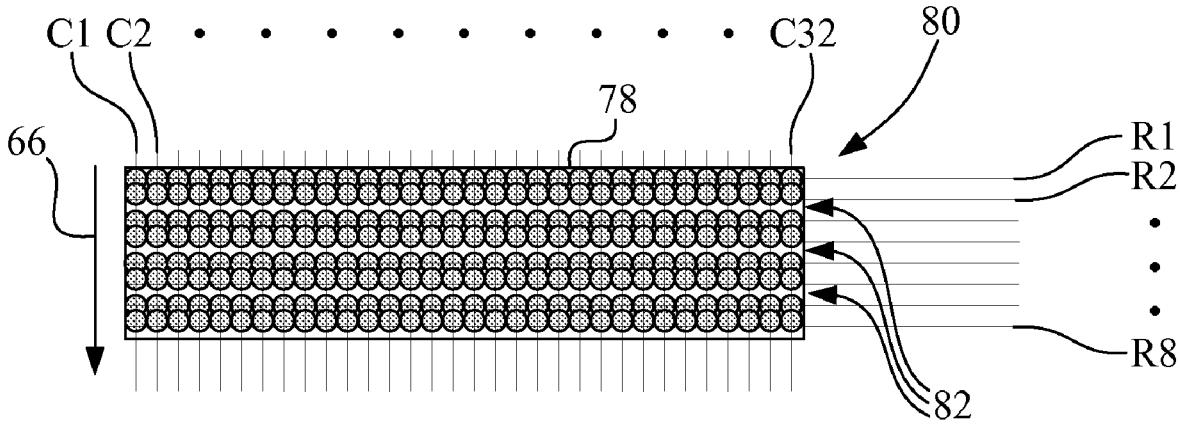
FIG. 5B illustrates the ideal pattern of dot locations of FIG. 5A after being subjected to media indexing errors.

FIG. 5B illustrates by example a printed pattern of dots 80 corresponding to the ideal pattern of dot locations 76 of FIG. 5A, wherein an indexing error was introduced by media transport system 54 as print medium 28 was incrementally fed under ink jet printhead 36 during printing. As in this example, when the dot size to dot spacing ratio is close to 1, a small indexing error, e.g., 5.0 um, introduced by media transport system 54 can make a large difference in the amount of print area 78 of print medium 28 that is covered by the dots, resulting in several horizontal bands 82 that extend across the entire width of print area 78.

Figure 6:
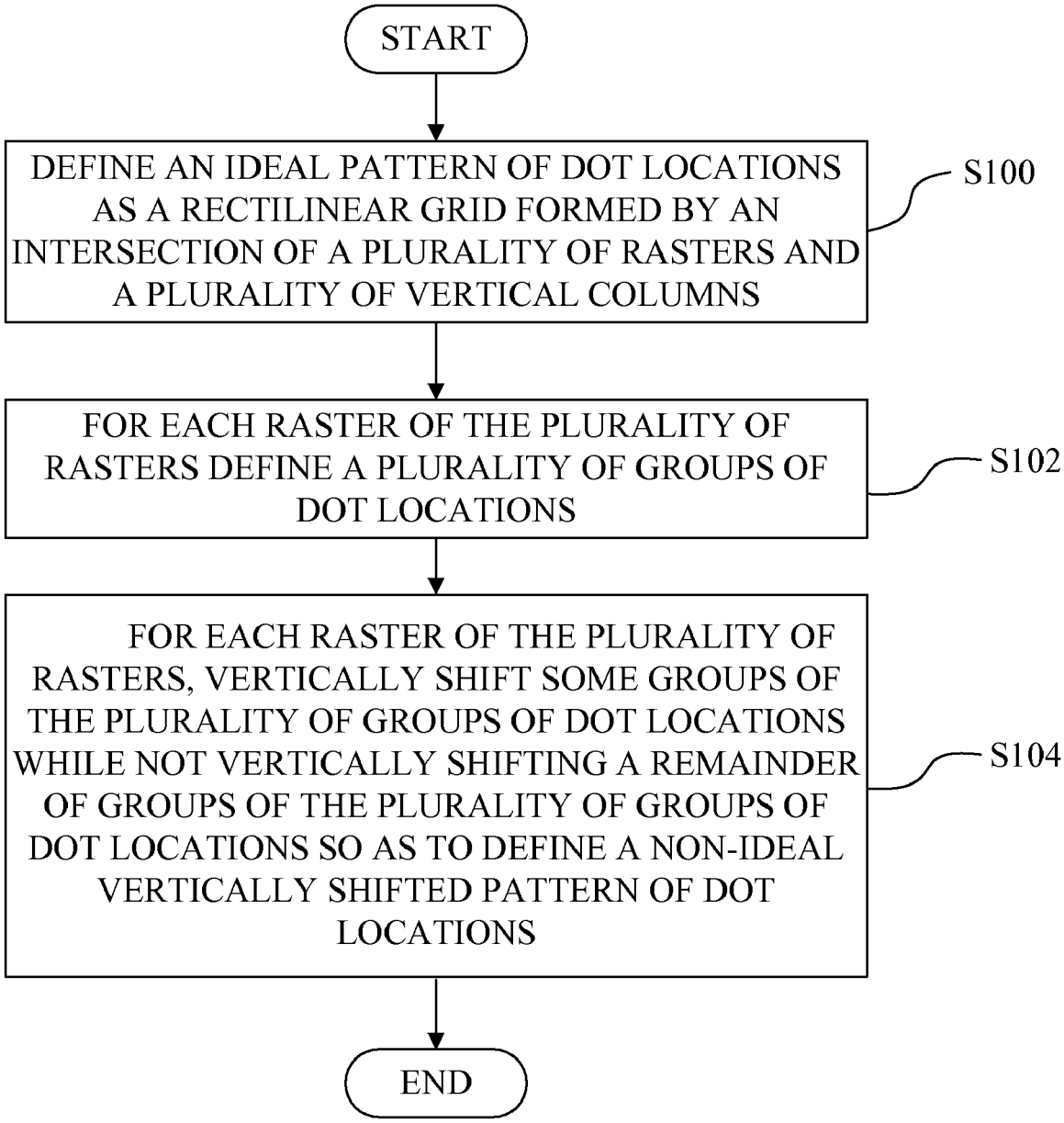
FIG. 6 is a flowchart of a method for decreasing sensitivity to errors in an imaging apparatus, such as indexing errors, in accordance with an embodiment of the present invention.
Figure 7A:
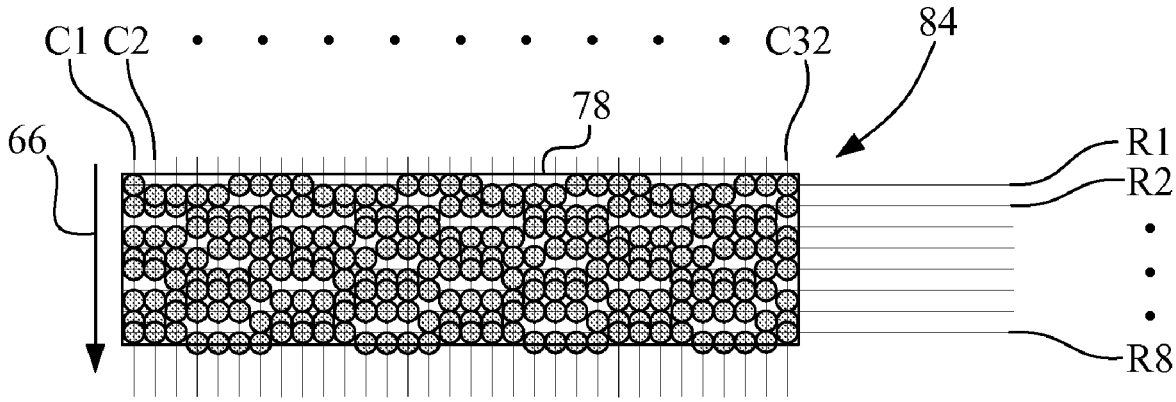
FIG. 7A illustrates a non-ideal vertically shifted pattern of dot locations generated in accordance with an embodiment of the present invention.

FIG. 6 is a flowchart of a method for decreasing sensitivity to errors in an imaging apparatus, such as indexing errors, in accordance with an embodiment of the present invention. In accordance with the present invention, as illustrated in FIG. 7A, a non-ideal vertically shifted pattern of dot locations 84 is defined to increase the robustness of imaging apparatus 12 to typical errors, such as indexing errors or errors caused by printhead carrier vibrations, thereby decreasing sensitivity to errors in imaging apparatus 12.

At step S100, an ideal pattern of dot locations, such as the ideal pattern of dot locations 76 described above, is defined. As set forth above, the ideal pattern of dot locations 76 is defined as a rectilinear grid formed by an intersection of a plurality of rasters R1, R2 . . . R8 and a plurality of vertical columns C1, C2 . . . C32.

At step S102, for each raster of the plurality of rasters R1, R2 . . . R8 a plurality of groups of dot locations is defined. For example, a size of group may be four adjacent dot locations along a respective raster. More particularly, for example, in raster R1 the first dot location R1, C1 may form a horizontal offset, with the first four dot group from left to right consisting of dot locations R1, C2; R1, C3; R1, C4; R1, C5, the second four dot group from left to right consisting of dot locations R1, C6; R1, C7; R1, C8; R1, C9, and so on. In raster R2 the first three dot locations R1, C1 may form a horizontal offset, with the first four dot group from left to right consisting of dot locations R2, C4; R2, C5; R2, C6; R2, C7, the second four dot group from left to right consisting of dot locations R2, C8; R2, C9; R2, C10; R2, C11, and so on. Similar groupings are defined in all remaining rasters, such as rasters R3 through R8 in the present example. Thus, each group of the plurality of groups of dot locations has a beginning dot location and an ending dot location, and wherein a first beginning dot location (e.g., R1, C2) of a first group (e.g., R1, C2; R1, C3; R1, C4; R1, C5) of one raster (e.g., raster R1) is not vertically aligned with a second beginning dot location (e.g., R2, C4) of a second group (e.g., R2, C4; R2, C5; R2, C6; R2, C7) of an adjacent raster (e.g., raster R2).

At step S104, for each raster of the plurality of rasters, some groups of the plurality of groups of dot locations are vertically shifted while a remainder of groups of the plurality of groups of dot locations are not vertically shifted, so as to define a non-ideal vertically shifted pattern of dot locations.

In the example of FIG. 7A, vertically shifted pattern of dot locations 84 may be generated by grouping dots in each raster R1-R8, and shifting every other grouping of dots relative to their respective ideal position. For example, in raster R1 from left to right the first vertically shifted group of four dots is in columns C2, C3, C4, and C5, and the shift continues for every other four dot grouping. In raster R2, from left to right, the first vertically shifted group of four dots is in columns C4, C5, C6, and C7, and the shift continues for every other four dot grouping. Similar shifting in rasters R3 through R8 is also illustrated. In this example, the grouping size is four dots, and the start location for the grouping is offset, e.g., staggered, as between adjacent rasters. Those skilled in the art will recognize that other grouping sizes may be used.

In this example, the amount of vertical shift is approximately one-half the dot spacing, creating a 50 percent overlap between rasters of dots. Again, assuming a dot spacing of 21 um, then the introduced vertical shift would be by approximately positive 10 um in the sheet feed direction 66. This overlap, while forcing a non-ideal pattern of dots, is less sensitive to small errors than the ideal pattern of dot locations 76 shown in FIG. 5A, as is illustrated by example in FIG. 7B.

Figure 7B:
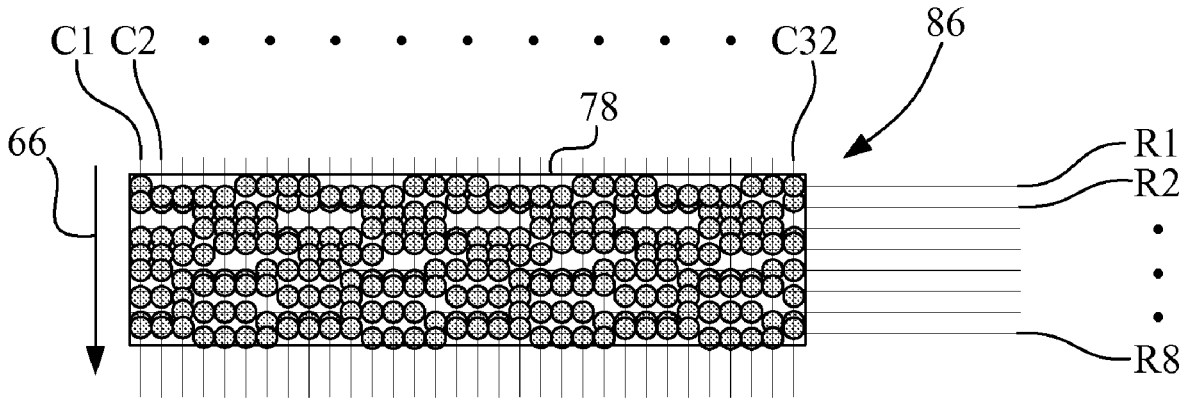
FIG. 7B illustrates the non-ideal vertically shifted pattern of dot locations of FIG. 7A after being subjected to media indexing errors.

FIG. 7B illustrates by example a printed pattern of dots 86 corresponding to the non-ideal vertically shifted pattern of dot locations 84 of FIG. 7A, wherein the non-ideal vertically shifted pattern of dot locations 84 was subjected to the same indexing error, e.g., 5.0 um, to which ideal pattern of dot locations 76 of FIG. 5A was subjected that resulted in the printed pattern of dots 80 of FIG. 5B. However, as may be observed by comparing FIGS. 5A and 5B, and FIGS. 7A and 7B, even with the indexing error, printed pattern of dots 86 of FIG. 7B resembles non-ideal vertically shifted pattern of dot locations 84 of FIG. 7A more closely than the printed pattern of dots 80 of FIG. 5B resembles the ideal pattern of dot locations 76 of FIG. 5A.

In other words, the differences between printed pattern of dots 86 of FIG. 7B and non-ideal vertically shifted pattern of dot locations 84 is much less obvious than the difference between printed pattern of dots 80 of FIG. 5B and the ideal pattern of dot locations 76 of FIG. 5A. Accordingly, printing using the non-ideal vertically shifted pattern of dot locations 84 may be more effective than the ideal pattern of dot locations 76 in avoiding objectionable printing artifacts that may be observed by the human eye. Thus, by introducing controlled non-ideal displacement of dots formed by the ink drops, sensitivity of imaging apparatus 12 to errors, e.g., indexing errors, is effectively decreased.

Step S104, i.e., the act of vertically shifting some groups of the plurality of groups of dot locations on each raster of said plurality of rasters, may be effected by defining a vertical shift amount, converting the vertical shift amount to a media feed (i.e., index) offset distance, and controlling media transport system 54 to convey print medium 28 using the media feed offset distance. The media feed offset distance may be, for example, in units of distance, e.g., inches or millimeters, or may be in units of stepper motor steps. The groups that are vertically shifted are relocated by a vertical shift amount that is in a range of approximately one-fourth to approximately one-half of a diameter of the nominal dot size. Here, the term approximate means plus or minus ten percent.

Thus, the vertical shifting of specific dots between and within rasters may occur by adding or subtracting the media feed index offset distance of a specified magnitude to selected base index moves within the sequence of moves of print medium 28 by media transport system 54, between successive passes of ink jet printhead 36 over print medium 28. For example, for 16 passes, there is a repetitive sequence of 16 index moves, some of which will be altered from the ideal move size with the specified index offset.

In one embodiment, for example, dots to be printed at locations defined by the groups associated with a particular raster, e.g., raster R1, that are vertically shifted are printed on a different printing pass from dots to be printed at locations defined by the remainder of the plurality of groups of dot locations on the particular raster that were not shifted. This scenario would apply to each raster of the plurality of rasters. As a more specific example, each of the plurality of groups may be defined by an associated shingling pattern used in multi-pass printing, such that the groups that are vertically shifted are printed on a different printing pass from dots to be printed at locations defined by the remainder of the plurality of groups of dot locations on each raster that were not shifted.

Figure 8:
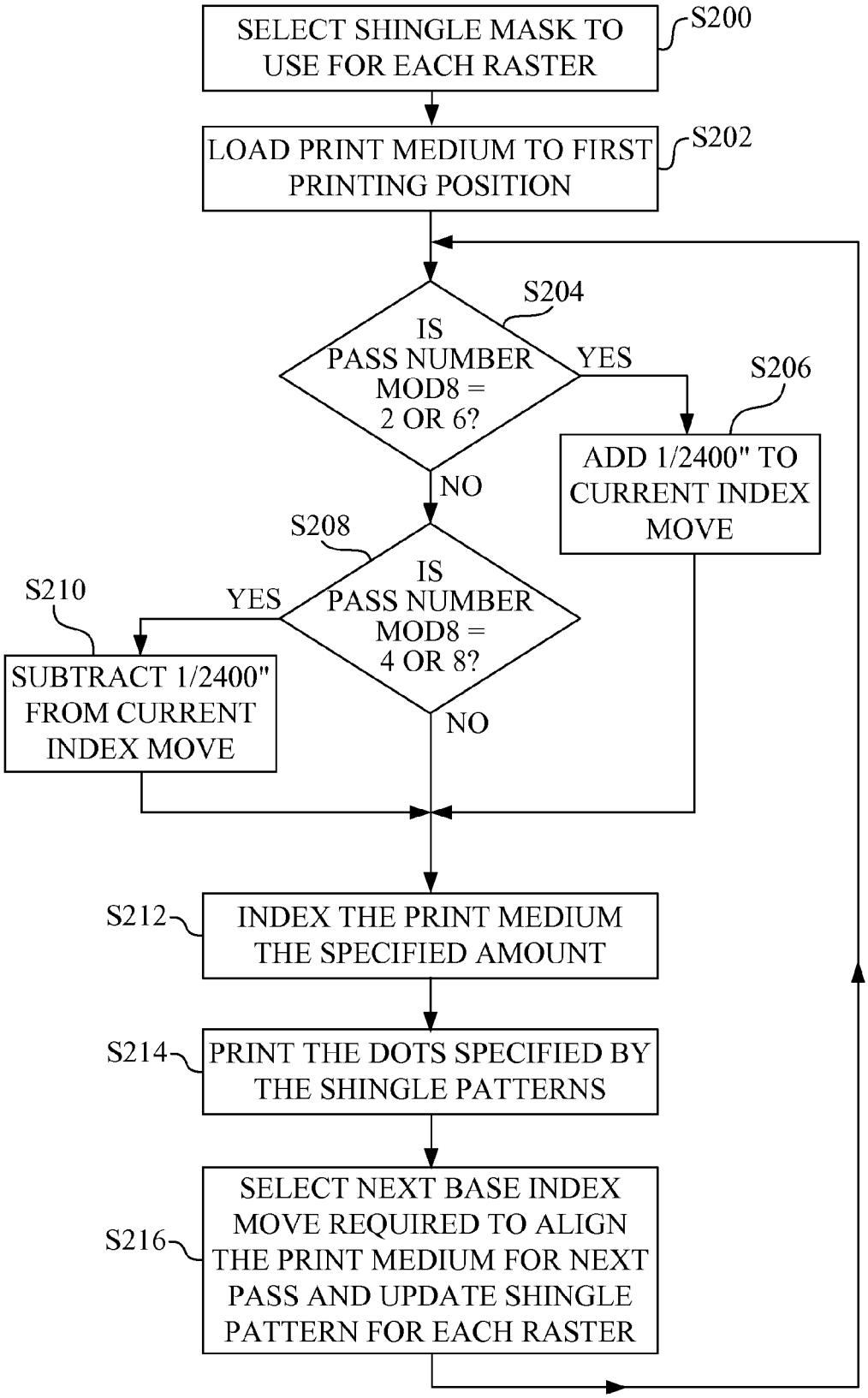
FIG. 8 is a flowchart of a method for generating a non-ideal vertically shifted pattern of dot locations, in accordance with an embodiment of the present invention that uses simple 8 pass printing.

FIG. 8 is a flowchart of a method for generating a non-ideal vertically shifted pattern of dot locations, in accordance with an embodiment of the present invention that uses simple 8 pass printing. The method steps may be implemented, for example, as program instructions executed by controller 18. As will be seen, the determination of which dots are printed on each pass may be controlled via a set of shingle patterns, wherein the combination of the shingle pattern used and the selected moves in which to add or subtract the index offsets produces the desired non-ideal vertically shifted pattern of dot locations.

Figure 9:
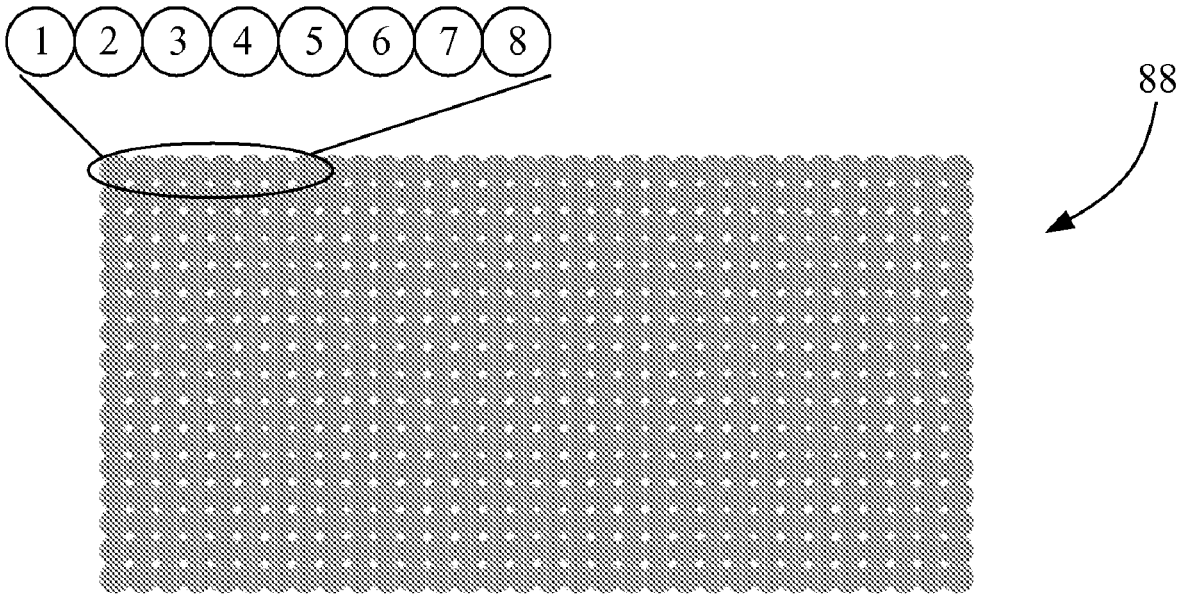
FIG. 9 illustrates an exemplary 1200×1200 dpi grid of dots used in illustrating the 8 pass printing of the method of FIG. 8.

At step S200, a shingle mask is selected for use with each raster. Referring to FIG. 9, an exemplary 1200×1200 dpi grid of dots 88 is shown, and it is assumed that imaging apparatus 12 is capable of addressing 1200×1200 dpi in each printing pass. A shingle mask selects a shingling pattern with respect to the pass numbers shown, wherein a "1" indicates that dot will be selected to be placed on the first pass of the printhead over that raster on print medium 28, a "2" indicates that dot will be selected to be placed on the second pass of the printhead over that raster on print medium 28, etc. The shingle order is repeated horizontally. The shingle order may be repeated vertically, but the initial point may be shifted horizontally depending on the raster.

At step S202, a current base index move is selected for loading print medium 28 to the first print position.

At step S204, it is determined whether the current pass number MOD8 is equal to 2 or 6.

If the determination at step S204 is YES, then at step S206 1/2400 of an inch is added to the distance of the current base index move of media transport system 54, and the process proceeds to step S212.

If the determination at step S204 is NO, then the process proceeds to step S208.

At step S208, it is determined whether the current pass number MOD8 is equal to 4 or 8. If the determination at step S208 is YES, then at step S210, 1/2400 of an inch is subtracted from the distance of the current base index move of media transport system 54, and the process proceeds to step S212.

If the determination at step S208 is NO, then the process proceeds to step S212.

At step S212, print medium 28 is moved, i.e., indexed, by the specified amount as determined in steps S202 through S210.

At step S214, dots are printed according to the shingle patterns.

At step S216, a next base index move is selected to align print medium 28 for the next pass and the shingle pattern is updated for each raster.

The process then returns to step S204, and the process steps S204 through S216 are repeated for the current pass of printhead 36 over print medium 28.

Figure 10:
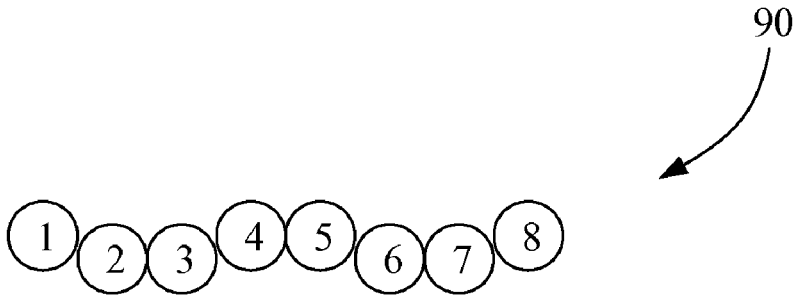
FIG. 10 illustrates a vertically shifted pattern of dot locations generated using the method of FIG. 8.

The method described above with respect to FIG. 8 couples a shingle pattern with index offsets, wherein a positive change is assumed to move the dot downward with respect to print medium 28, i.e., in the sheet feed direction 66, as follows: index move before pass number 2: positive 1/2400 of an inch; index move before pass number 4: negative 1/2400 of an inch; index move before pass number 6: positive 1/2400 of an inch; and index move before pass number 8: negative 1/2400 of an inch. As a result, a vertically shifted pattern of dot locations 90 is achieved, as illustrated in FIG. 10.

Those skilled in the art will recognize that the method described above with respect to FIG. 8 may be adapted for use with any number of shingling passes. The following example is an application involving 16 pass printing with an imaging apparatus, e.g., imaging apparatus 12, capable of printing 1200×600 dpi swaths.

Figure 11:
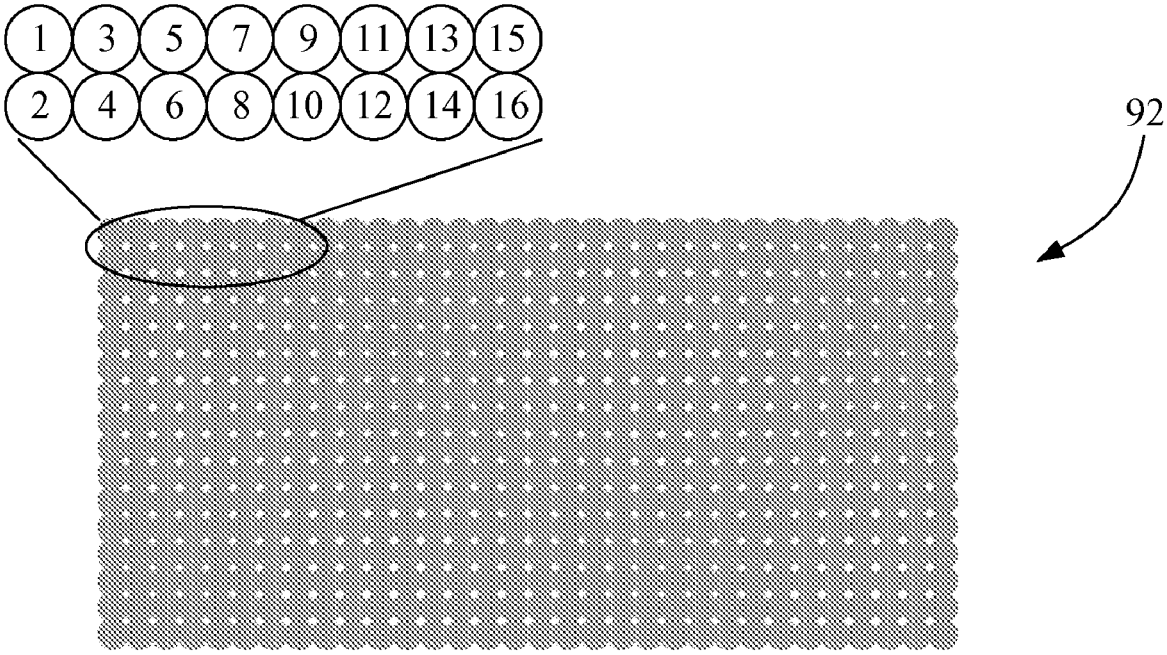
FIG. 11 illustrates an exemplary 1200×1200 dpi grid of dots used in illustrating an exemplary 16 pass printing.

FIG. 11 shows an exemplary 1200×1200 dpi grid of dots 92, and it is assumed that imaging apparatus 12 is capable of addressing 1200×600 in each printing pass. Therefore, odd rasters will be addressed on odd passes, and even rasters on even passes. Again, the number in the dot represents the pass on which the dot will be formed. In other words, a shingle mask selects a shingling pattern with respect to the pass numbers shown, wherein a "1" indicates that dot will be selected to be placed on the first pass of the printhead over that raster on print medium 28, a "2" indicates that dot will be selected to be placed on the second pass of the printhead over that raster on print medium 28, etc. The 1200×1200 dpi grid of dots is shown, but it is assumed that the printing system is capable of addressing 1200×600 in each printing pass.

In this example, the selected locations in the indexing sequence of 16 moves are before passes 2, 4, 6, 10, 12, and 14 and the index offset alternates between an addition of a $1/4800$ of an inch and a subtraction of $1/4800$ of an inch. Also, in this example, assume base index moves of $37/1200$ of an inch and $41/1200$ of an inch. Therefore the indexing sequence for the 16 passes is as set forth in Table 1, as follows:

TABLE 1

EXEMPLARY INDEXING SEQUENCE FOR 16 PASS PRINTING

| PASS NUMBER | BASE INDEX MOVE (in inches) | INDEX OFFSET (in inches) |
|---|---|---|
| 1 | 37/1200 | |
| 2 | 41/1200 | +1/4800 |
| 3 | 37/1200 | |
| 4 | 41/1200 | −1/4800 |
| 5 | 37/1200 | |
| 6 | 41/1200 | +1/4800 |
| 7 | 37/1200 | |
| 8 | 41/1200 | |
| 9 | 37/1200 | |
| 10 | 41/1200 | −1/4800 |
| 11 | 37/1200 | |
| 12 | 41/1200 | +1/4800 |
| 13 | 37/1200 | |
| 14 | 41/1200 | −1/4800 |
| 15 | 37/1200 | |
| 16 | 41/1200 | |

Figure 12:
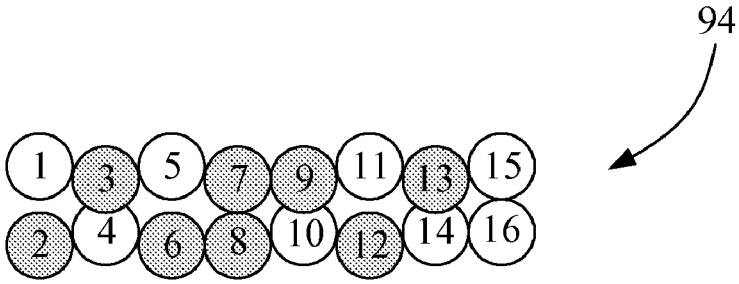
FIG. 12 illustrates a vertically shifted pattern of dot locations associated with the exemplary 16 pass printing of FIG. 11.

In this example, one-fourth dot diameter size offsets, e.g., $1/4800$ of an inch, were used. With the above offsets and the defined shingle pattern the resulting vertically shifted pattern of dot locations 94 is achieved, as illustrated in FIG. 12, wherein the dots moved from the ideal dot locations are highlighted in gray.

Figure 13:
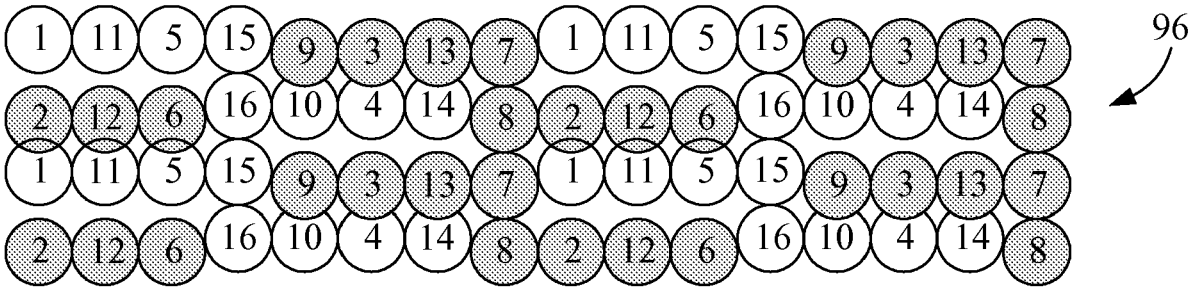
FIG. 13 illustrates a vertically shifted pattern of dot locations generated using a different shingle order from that used in generating the vertically shifted pattern of dot locations of FIG. 12.

Alternatively, if a different shingle order was defined, keeping the same index offset versus pass number, a different pattern of vertically shifted dots on each raster can be achieved, as in the resulting vertically shifted pattern of dot locations 96 illustrated in FIG. 13. Again, the number in the dot represents the pass on which the dot will be formed. Additionally, by choosing different starting locations for the dot groups for each raster, one can effectively shift the patterns on each raster relative to the above, resulting in the vertically shifted pattern of dot locations 84 having the predominant four dot groupings of dots in each raster R1-R8, as shown in FIG. 7A and described more fully above.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A method for decreasing sensitivity to errors in an imaging apparatus, comprising:

defining an ideal pattern of dot locations as a rectilinear grid formed by an intersection of a plurality of rasters and a plurality of vertical columns;

for each raster of said plurality of rasters defining a plurality of groups of dot locations; and for each raster of said plurality of rasters, vertically shifting some groups of said plurality of groups of dot locations while not vertically shifting a remainder of groups of said plurality of groups of dot locations so as to define a non-ideal vertically shifted pattern of dot locations.

2. The method of claim 1, further comprising determining a nominal dot size for a dot to be printed, wherein the groups that are vertically shifted are relocated by a vertical shift amount that is in a range of one-fourth to one-half, inclusive, of a diameter of said nominal dot size.

3. The method of claim 1, further comprising determining a nominal dot size for a dot to be printed, wherein the groups that are vertically shifted are relocated by a vertical shift amount that is in a range of approximately one-fourth to approximately one-half of a diameter of said nominal dot size.

4. The method of claim 1, wherein said imaging apparatus includes a print engine having an ink jet printhead for ejecting a plurality of ink drops to form a corresponding plurality of dots on a print medium, wherein dots to be printed at locations defined by the groups that are vertically shifted of said plurality of groups of dot locations on each raster are printed on a different printing pass from dots to be printed at locations defined by said remainder of said plurality of groups of dot locations on each raster that were not shifted.

5. The method of claim 4, wherein said print engine includes a media transport system for feeding said print medium under said ink jet printhead, wherein the act of vertically shifting some groups of said plurality of groups of dot locations on each raster of said plurality of rasters includes, for each group to be shifted:

defining a vertical shift amount;

converting said vertical shift amount to at least one media feed offset distance; and controlling said media transport system to convey said print medium using said at least one media feed offset distance.

6. The method of claim 5, wherein said vertical shift amount is one of a positive amount and a negative amount depending on said group.

7. The method of claim 1, wherein each group of said plurality of groups of dot locations on each raster of said plurality of rasters has a beginning dot location and an ending dot location, and wherein a first beginning dot location of a first group of a first raster is not vertically aligned with a second beginning dot location of a second group of a second raster that is adjacent to said first raster.

* * * * *